US006279357B1

(12) United States Patent
Didlick et al.

(10) Patent No.: US 6,279,357 B1
(45) Date of Patent: Aug. 28, 2001

(54) WASHER DRYER

(75) Inventors: Laurence P Didlick, Peterborough; David Cupit, Stoke-on-Trent, both of (GB)

(73) Assignee: General Domestic Appliances Limited (GB)

( * ) Notice: Subject to any disclaimer, the term of this patent is extended or adjusted under 35 U.S.C. 154(b) by 0 days.

(21) Appl. No.: 09/334,372

(22) Filed: Jun. 16, 1999

(51) Int. Cl.[7] ..... D06F 37/00; D06F 58/24
(52) U.S. Cl. ..... 68/20; 34/75; 34/77; 68/142
(58) Field of Search ..... 68/20, 142; 34/75, 34/77, 602, 603

(56) References Cited

U.S. PATENT DOCUMENTS 2,724,905 * 11/1955 Zehrbach ..... 34/75
2,792,640 * 5/1957 Patterson ..... 34/75
2,873,537 * 2/1959 Gray, Jr. et al. ..... 34/75
2,892,335 * 6/1959 Gray, Jr. ..... 68/20 X
2,990,708 * 7/1961 Martin et al. ..... 68/20
3,111,018 * 11/1963 Bonner ..... 68/20
3,121,000 * 2/1964 Hubbard ..... 68/20 X
3,922,798 12/1975 McMillan .
5,746,070 * 5/1998 Bailey et al. ..... 68/142 X

FOREIGN PATENT DOCUMENTS 786389 11/1957 (GB) .

* cited by examiner

*Primary Examiner*—Philip R. Coe
(74) *Attorney, Agent, or Firm*—Kirschstein, et al.

(57) ABSTRACT

In a washer dryer in which a drum supported by a spider is rotatable in a tub, the rear wall of the tub is contoured such as by providing castellation-like recesses, and water may be fed over this rear wall via a water inlet so that, in a drying mode, when the drum is rotated and moist air is drawn from the drum, the moist air is agitated by being dragged by the rotation of the drum past the tortuous profile over which water is trickled, to promote efficient condensation before the air is heated and returned to the drum in a recirculating path.

13 Claims, 6 Drawing Sheets

WASHER DRYER

BACKGROUND OF THE INVENTION

This invention relates to washer dryers.

Washer dryers typically comprise a rotatable drum for receiving a load to be washed, inside a non-rotatable tub. When the washing part of the washing/drying cycle has been completed, moist air is repeatedly drawn from the drum in a closed recirculation path, passed through a condensing region to remove some of the moisture, heated and returned to the drum.

It has been proposed in U.S. Pat. No. 2,792,640 and in German Patent No. 196 15 823 to provide a condenser disc on the rear of the drum, spraying water onto the condenser disc to promote the condensation of moisture out of the re-cycled air from the drum.

However, in recent years, it has been usual to provide a molding to define the condensing region, constructed as a hollow arm arranged vertically, which communicates at one end with an outlet of the tub and at the other end with an inlet to a box containing a heating element. Water is trickled down the hollow arm while the moist air flows up it. Such an arrangement was adopted because it was felt that the relatively restricted cross-sectional area of the arm promoted heat transfer between the moist air and the water.

A problem with such an arrangement has however been fluff and fibres (lint) carried out of the drying clothes in the stream of moist air became deposited inside the hollow arm. A separate water jet therefore had to be provided to clear any build-ups of lint, and this was done during the wash cycle, but it was not totally successful. Lint could still block to such an extent that drying performance was impaired necessitating the summoning of a service engineer.

SUMMARY OF THE INVENTION

The invention provides a washer dryer, comprising a tub containing a rotatable drum for receiving a washing load, a recirculation path for recirculating drying air through the drum in a drying mode, the recirculation path including a condensing region between the rear of the drum and the rear of the tub, wherein the surface of the rear of the tub facing the rear of the drum is contoured.

Because the condensing region is within the tub, any lint deposited in the region is swept clear during the next washing cycle, and the contouring of the inner face of the rear of the tub improves the efficiency of condensation in the drying cycle.

The rear of the tub may be provided with recesses, which may alternate with non-recessed regions in a peripheral direction around the axis of the tub, and projecting ribs may also be provided on the rear of the tub. These parts may all be formed during a molding operation to form the tub.

Advantageously, water is fed onto the rear of the tub, and a water outlet in the rear of the tub may be provided for this purpose, which may be fed with mains water via a solenoid valve during the drying cycle, but which is preferably fed from a reservoir into which water which drains into the bottom of the tub is continuously recirculated. The water inlet may have a deflector to confine as much as possible of the incoming water to the convoluted rear face of the tub.

BRIEF DESCRIPTION OF THE DRAWINGS

Washer dryers constructed in accordance with the invention will now be described, by way of example, with reference to the accompanying drawings, in which.

DETAILED DESCRIPTION OF THE PREFERRED EMBODIMENT

Figure 1:
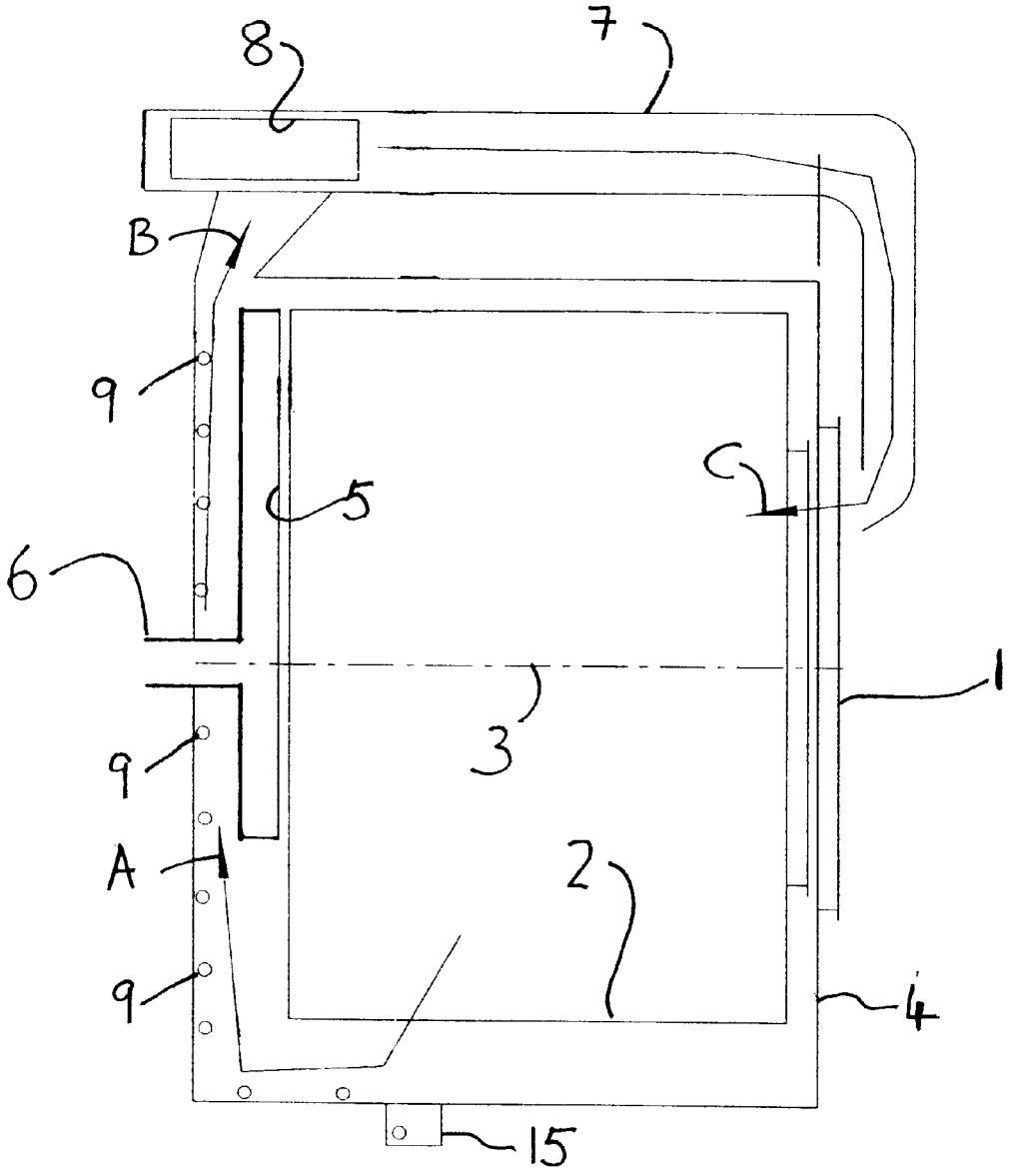
FIG. 1 is a sectional view in schematic form of a first washer dryer.

Throughout the figures, like reference numerals have been given to like parts.

Referring to FIG. 1, the cabinet of the washer dryer is not shown. Clothes are loaded through a door 1 into a drum 2 which is rotatable about an axis 3 inside a tub 4. The drum is rotatably supported by means of a spider 5 attached to the rear of the drum. The spider carries a shaft 6 by means of which the drum is mounted and driven.

The washer dryer can operate in a drying mode as well as in a washing mode.

A recirculation path is provided for recirculating drying air through the drum in a drying mode. Moist air from the clothes leaves the lower region of the drum (in the direction of arrow A) into a condensing region of the recirculation path between the rear of the drum 2 and the rear of the tub 4. A fan 8 draws the air from this region into heater 7 (arrow B), where the air is heated before being returned to the drum (arrow C). Moist air leaves the lower region of the drum 2 predominantly because the clearance between the tub and the drum is greater beneath the drum than above the drum, a greater space being provided to accommodate elements (not shown) for heating the water during a wash cycle. The drum is of course perforated.

Means (not shown) is provided for producing a trickle of water 9 down the surface of the rear of the tub 4 which faces the rear of the drum 2, and this surface is also contoured (although this is not shown in FIG. 1). The result of this is that moisture is condensed very efficiently in the condensing region in the drying cycle, during which the drum is rotated.

Lint will tend to accumulate in the space between the rear of the drum 2 and the rear of the tub 4, but this will be washed away on the next wash cycle.

FIG. 1 shows the components of the first washer dryer only schematically. The second and third washer dryers, shown in FIGS. 2 to 5, and FIGS. 6 to 8, respectively, are detailed constructional forms of the first washer dryer.

Figure 2:
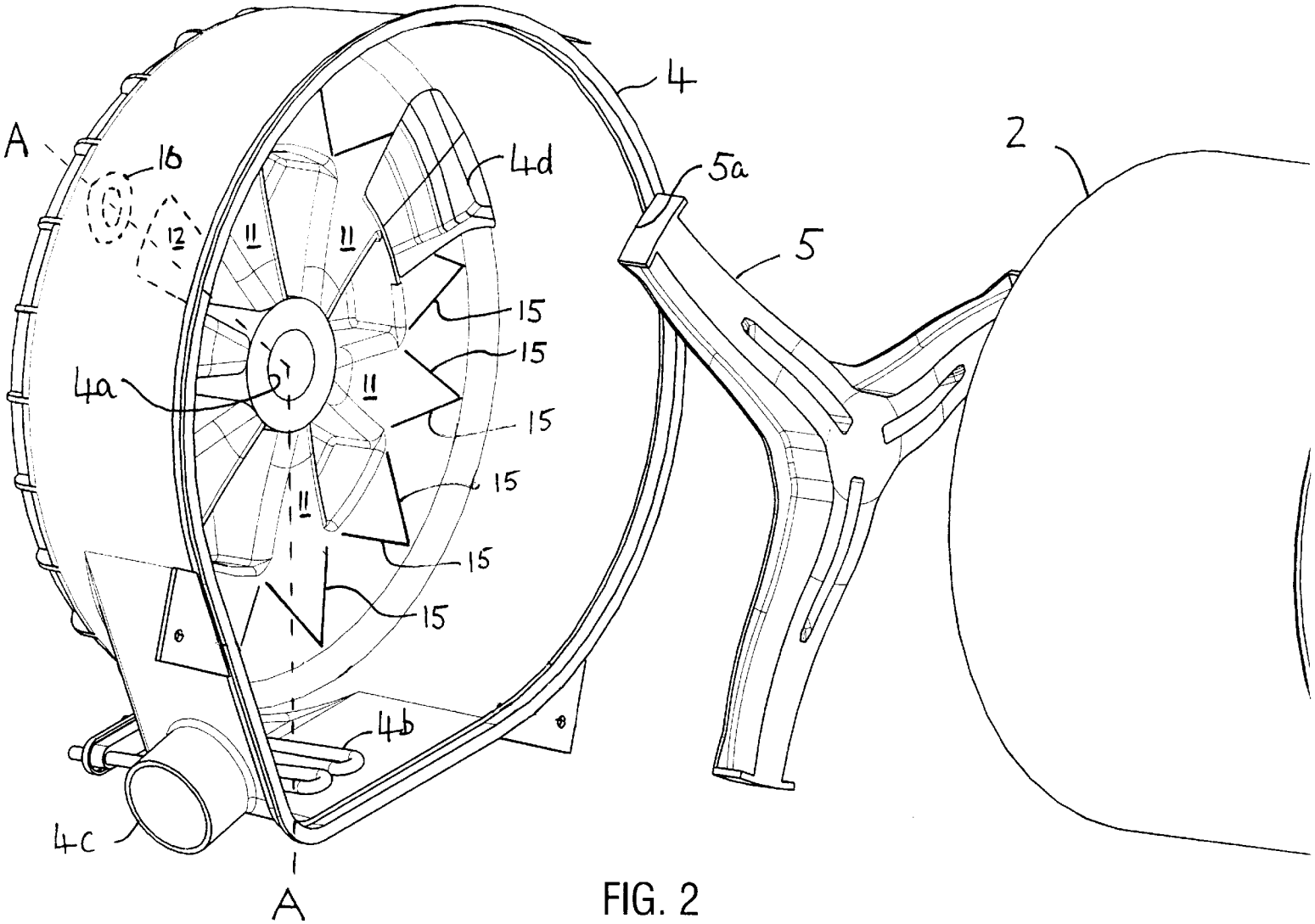
FIG. 2 is an exploded view of a part of a second washer dryer.

Referring to FIGS. 2 to 5, the second washer dryer comprises a drum 2 rotatably mounted in a tub 4 only part of which is shown in FIG. 2. Another sleeve-like portion secures to the rim seen at the right hand edge of the part of the tub shown in FIG. 2. It will be seen in FIG. 3 that the front of the drum 2 (seen at the right hand side of FIG. 3) has an opening 2*a* for receiving the washing load, while the rear of the drum 2*b* is inwardly dished. The drum is supported by means of the spider 5, which engages on a corresponding formation pressed out of the rear 2*b* of the drum. The spider 5 carries a shaft (not shown) which is rotatably supported in bearings contained in hub 4*a* which is integrally formed with the rear wall of the tub. The spider 5 has flats 5*a* at the ends of its arms, which are secured to a lip extending from the rear end of the drum beyond the rear wall 2*b*.

The tub 4 has a heating element 4*b* and an outlet 4*c*, from which the washing liquid is pumped during and at the end of the washing cycle. Moist air is withdrawn by means of a fan (not shown) via aperture 4*d* in the rear of the tub 4.

The surface of the rear of the tub which faces the rear of the drum is contoured in a castellated form in a direction around the circumference of the axis of the tub. Thus, raised regions 11 alternate with depressed regions 12, the whole of the part of the tub shown being molded as one piece out of plastics material. The recesses are relatively deep, but extend for about half the radius of the rear face of the tub. The outer half of the radius is not recessed, but is provided with projecting ribs 15.

Figure 5:
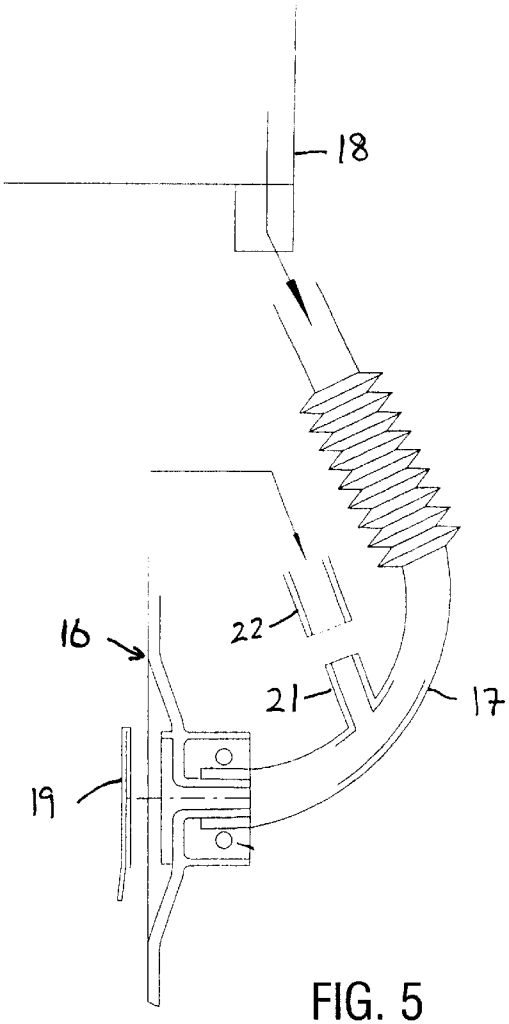
FIG. 5 is an enlarged view of a detail of the second dryer.
Figure 3:
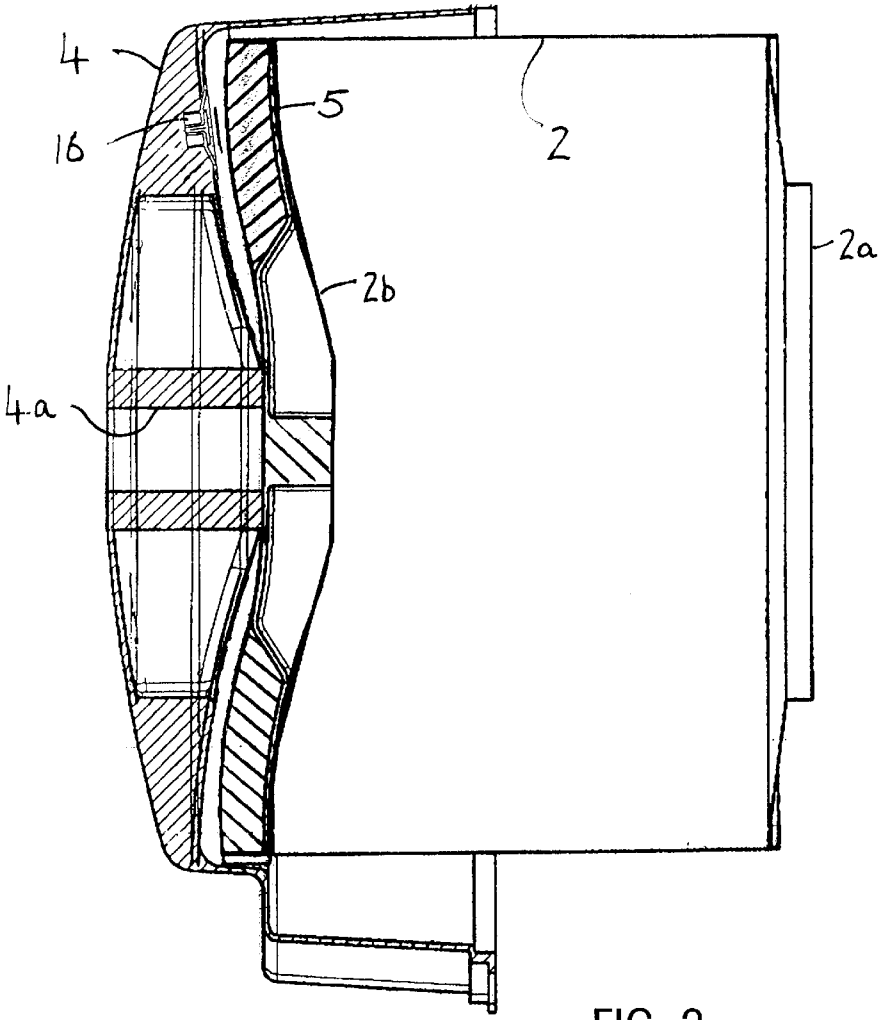
FIG. 3 is a developed sectional view taken through the lines A—A in FIG. 2.

In the non-recessed region beyond one of the recesses 12, a water inlet 16 is provided, and by means of this water trickles down the rear face of the tub. The water inlet 16 is shown in FIG. 3, since this is a developed view, but the connections to it are not shown. These are shown in FIG. 5. Thus, the water inlet 16 is fed via a pipe 17 with a flexible portion from a reservoir 18 (not shown in FIGS. 2 to 4). In order to ensure that the gravity fed flow spreads over the rear surface of the tub rather than the rear surface of the drum, a deflector plate 19 is provided.

Figure 4:
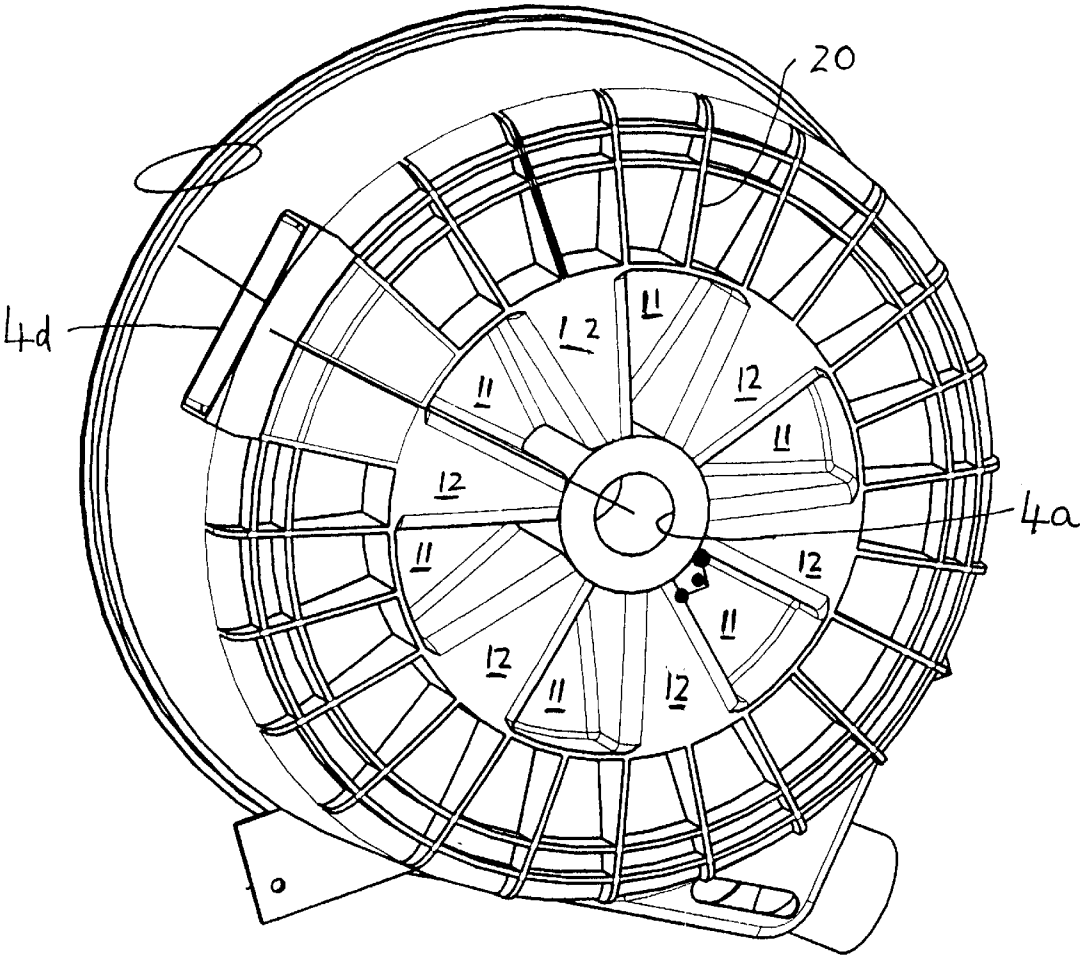
FIG. 4 is a perspective view of the rear of the tub of the second dryer.

The tub 4 is provided with a large number of radial and circular strengthening ribs, one of which is indicated as the reference numeral 20 in FIG. 4. The water inlet is formed integrally with the rear of the tub in the moulding operation. It should be noted that the hatched region shown behind the water inlet in FIG. 3 denotes one of the radial stiffening ribs.

The reservoir 18 is provided with a pump for replenishing the reservoir from water which has passed through the water inlet and drained to the bottom of the tub. At the start of a drying operation, the reservoir 18 is filled from the mains, e.g. via a solenoid operated valve. The reservoir is open at the bottom and so flow immediately passes down the pipe 17 and out of the water inlet 16. The water, which trickles down over the castellated rear surface of the tub 4, is spread out over a wider area of the surface by the air flow. Turbulence is created in the air flow by the rotary movement of the inner drum 2 relative to the stationary tub 4. This promotes condensation of the moist air drawn from the drum 2 via a fan (not shown), so an increased volume of water drains to the bottom of the tub, which is continuously pumped back to the reservoir 18. The bore of the pipe 17 and of the outlet from the reservoir 18, as well as the outlet of the water inlet 16, are all large diameter, because lint will be entrained with this water. As a further safeguard to prevent any blocking of the water supply, the pipe 17 has a T-junction at 21 which communicates with pipe 22 through which is fed water diverted from the dispenser assembly every time cold water is fed to the washing machine. Of course, lint will deposit itself on the rear of the tub, but this will also get cleared away each time the washer dryer is used, since it will be cleared away on the next wash cycle. A temperature sensor is provided so that if the water temperature in the reservoir exceeds 45° C., the recirculation pump is shut off and the reservoir is refilled from the mains. It is thought that the efficiency of the condensation would be reduced above this temperature.

At the end of the drying cycle, the recirculation pump is shut off and the water which drains to the floor of the tub is then pumped to the outlet using the usual drain pump.

It has been found that a washing machine of the kind shown in FIGS. 2 to 5 is very efficient in removing moisture from the recirculated drying air. While the reasons for this efficiency are not fully understood, it is believed that the turbulence in the air dragged around by the spider 5 which is created by the recesses 12 is partly responsible, as is the fact that the spider 5 is set close to the inner face of the rear wall of the tub which results in agitation of the air as the spider 5 is rotated. Another possible reason is that the castellated profile of the rear face of the tub has an increased surface area at which moisture deposition can take place.

In addition to being efficient from the point of view of drying, there is also a considerable water saving compared to the type of washer dryer using an upright arm to define the condensing region. This latter type used, typically, 30 liters of water during a drying cycle, while the version described above requires in the region of 4 to 8 liters per drying cycle.

Another advantage is that, since the separate component representing the condensing region has been deleted, it is possible to extend the tub back further because this component was located behind the tub.

Another advantage of the design is that the drum 2, spider 5 and tub 4 can be identical for washing machines which do not have a drying facility, since it is merely necessary to cap the water inlet 16. The reservoir 18 would not be provided in such a case.

Of course, it is not essential for the reservoir 18 to be provided in the case of a washer dryer. If desired, the water fed to the rear wall of the drum could be provided via a solenoid operated valve from the mains as hitherto.

Figure 6:
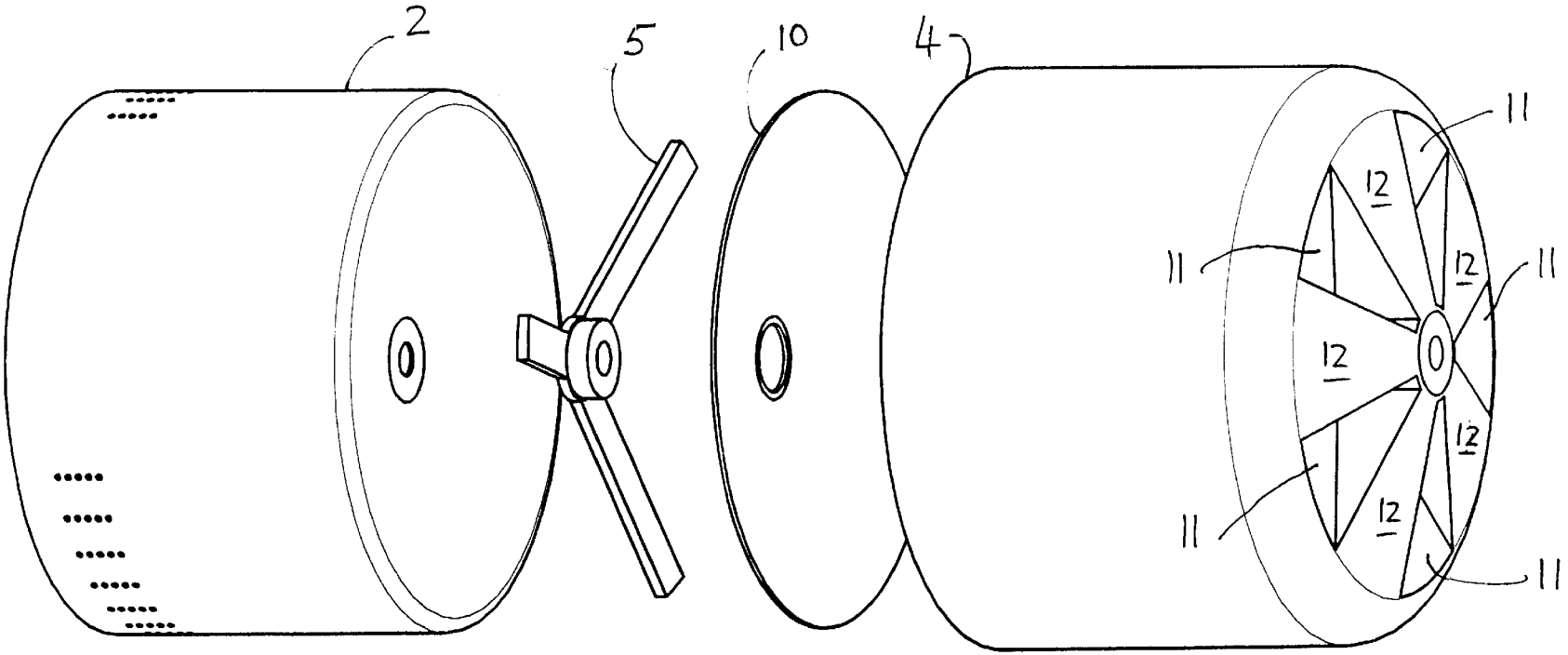
FIG. 6 is an exploded view of parts of a third washer dryer.
Figure 8:
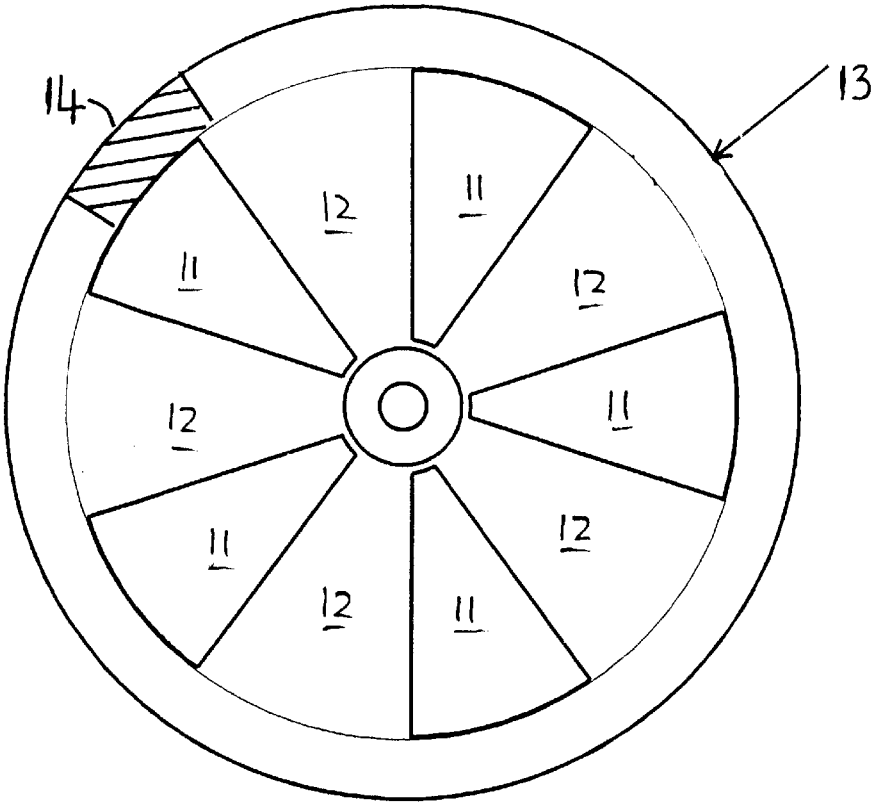
FIG. 8 is an end view of the rear of the tub of the third dryer.
Figure 7:
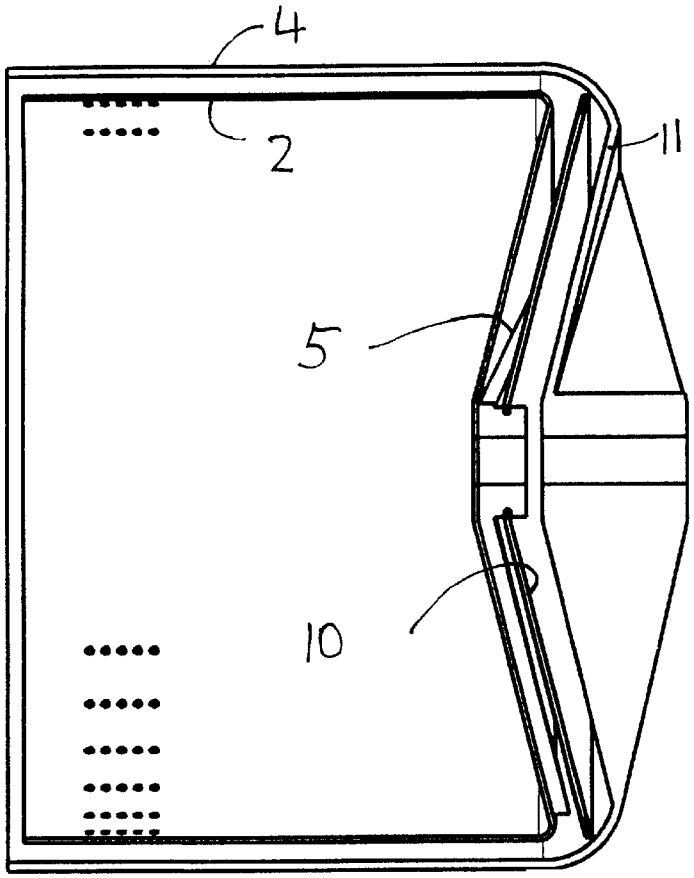
FIG. 7 is a sectional view showing the parts of FIG. 6 in an assembled condition.

The third form of washer dryer differs from the second form in that the spider 5 carries a disc 10 of stainless steel or aluminum in order to assist in condensation. Another difference is that the castellations of the rear wall of the tub now extend the full radius of the rear wall. The water inlet is at 13 and the air outlet is at 14. A suitable water inlet would be the inlet 16 shown in FIGS. 2 to 5. However, it would also be possible for the water inlet to be directed onto the condenser disc 10. While the water is again trickled down the rear face of the tub, the condensing disc 10 would also promote condensation. While the condensing disc as shown in FIG. 6 to 8 is secured to the spider 5 and rotates with the drum 2, the disc could be secured to the tub so as to be non-rotatable and, in such a case, advantage could be taken of this to fit a hollow disc through which cooling water or air was circulated, for example, by means of a pump or fan, respectively.

Modifications may be made without departing from the scope of the invention. Thus, the tub of the third washer dryer could be replaced by the tub of the second washer dryer and vice versa, and a condenser disc could be fitted in the second washer dryer if desired. Also, the tubs of either the second or third washer dryer could be made of metal instead of plastics material, e.g., stainless steel, in which case the contouring could be performed by pressing rather than by molding.

What is claimed is:

1. A washer-dryer machine for washing and drying a load during respective washing and drying cycles, comprising:

a) a tub having a tub wall;

b) a drum for receiving the load and mounted in the tub for rotation about an axis, the drum having a drum wall spaced from, and bounding with, the tub wall a condensing region through which moist air from the drum is drawn during the drying cycle for moisture removal; and c) a plurality of raised regions and a plurality of recessed regions on a surface of the tub wall that faces the drum wall, the raised and recessed regions alternating with one another in a circumferential direction about the axis.

2. The machine of claim 1, wherein the tub has a hub integral with the tub wall and through which a drive shaft extends.

3. The machine of claim 1, wherein the drum wall has an inwardly dished configuration.

4. The machine of claim 1, and further comprising a spider having a plurality of radial arms for holding the drum, the spider being located between the tub wall and the drum wall.

5. The machine of claim 1, wherein the tub wall is circular and has a radius, and wherein each of the raised and recessed regions extends radially of the axis for a distance equal to about one-half of the radius.

6. The machine of claim 1, and further comprising a plurality of ribs on the tub wall and extending radially of the axis.

7. The machine of claim 1, and flier comprising a water inlet for feeding water onto the tub wall.

8. The machine of claim 7, and further comprising a deflector plate for deflecting the water fed from the inlet toward the tub wall.

9. The machine of claim 7, and further comprising a gravity feed reservoir connected to the inlet.

10. The machine of claim 9, and further comprising a pipe between the reservoir and the inlet, and a T-junction for gaining access to the pipe.

11. The machine of claim 1, and further comprising a metal disc located between the tub wall and the drum wall.

12. The machine of claim 1, wherein the tub wall is circular and has a radius, and wherein each of the raised and recessed regions extends radially of the axis for a distance equal to the radius.

13. The machine of claim 1, and further comprising a plurality of circular ribs and a plurality of radial ribs on an exterior surface of the tub wall.

* * * * *